US009637824B2

(12) United States Patent
Birnkrant

(10) Patent No.: US 9,637,824 B2
(45) Date of Patent: May 2, 2017

(54) COATING FOR METAL CELLULAR STRUCTURE AND METHOD THEREFOR

(71) Applicant: United Technologies Corporation, Hartford, CT (US)

(72) Inventor: Michael J. Birnkrant, Kenilworth, NJ (US)

(73) Assignee: United Technologies Corporation, Hartford, CT (US)

( * ) Notice: Subject to any disclaimer, the term of this patent is extended or adjusted under 35 U.S.C. 154(b) by 108 days.

(21) Appl. No.: 14/507,945

(22) Filed: Oct. 7, 2014

(65) Prior Publication Data

US 2015/0111022 A1 Apr. 23, 2015

Related U.S. Application Data

(60) Provisional application No. 61/894,650, filed on Oct. 23, 2013.

(51) Int. Cl.

| | |
|---|---|
| ***B22F 3/11*** | (2006.01) |
| ***C23C 18/12*** | (2006.01) |
| ***C22C 1/08*** | (2006.01) |
| ***B22F 1/00*** | (2006.01) |
| ***C22C 32/00*** | (2006.01) |

(52) U.S. Cl.

CPC ..... *C23C 18/1254* (2013.01); *B22F 1/0018* (2013.01); *B22F 3/1125* (2013.01); *B22F 3/1143* (2013.01); *C22C 1/08* (2013.01); *C22C 32/0084* (2013.01); *C23C 18/1216* (2013.01); *C23C 18/1283* (2013.01); *B22F 1/0022* (2013.01); *B22F 1/0059* (2013.01); *B22F 2201/03* (2013.01); *B22F 2201/04* (2013.01); *B22F 2302/40* (2013.01);

(Continued)

(58) Field of Classification Search

None

See application file for complete search history.

(56) References Cited

U.S. PATENT DOCUMENTS

| | | | |
|---|---|---|---|
| 5,592,686 | A | 1/1997 | Third et al. |
| 5,848,351 | A | 12/1998 | Hoshino et al. |

(Continued)

FOREIGN PATENT DOCUMENTS

| | | |
|---|---|---|
| WO | 2006118186 | 11/2006 |
| WO | 2010041014 | 10/2008 |

OTHER PUBLICATIONS

Luther, E. et al. (2009). Nanostructured metal foams: Synthesis and applications. PowderMet2009, Las Vegas, NV.

*Primary Examiner* — George Wyszomierski

(74) *Attorney, Agent, or Firm* — Carlson, Gaskey & Olds, P.C.

(57) ABSTRACT

A method of fabricating a metal cellular structure includes providing a sol-gel that is a colloid dispersed in a solvent, the colloid including metal-containing regions bound together by polymeric ligands, removing the solvent from the gel using supercritical drying to produce a dry gel of the metal-containing regions bound together by the polymeric ligands, and thermally converting the dry gel to a cellular structure with a coating in at least one step using phase separation of at least two insoluble elements. Also disclosed is a metal cellular structure including interconnected metal ligaments having a cellular structure and a carbon-containing coating around the metal ligaments.

16 Claims, 3 Drawing Sheets

(52) U.S. Cl.
CPC ..... *B22F 2302/45* (2013.01); *C22C 2200/02* (2013.01); *Y10T 428/249921* (2015.04)

(56) References Cited

U.S. PATENT DOCUMENTS

| | | | | |
|---|---|---|---|---|
| 6,238,819 | B1 * | 5/2001 | Cahill | B22F 3/1103 29/2 |
| 6,719,947 | B1 | 4/2004 | Jha et al. | |
| 6,818,081 | B2 | 11/2004 | Gash et al. | |
| 6,986,818 | B2 | 1/2006 | Tillotson et al. | |
| 6,986,819 | B2 | 1/2006 | Tillotson et al. | |
| 8,172,964 | B2 | 5/2012 | Gash et al. | |
| 8,226,861 | B2 | 7/2012 | Hayes et al. | |
| 8,303,883 | B2 | 11/2012 | Landingham et al. | |
| 2006/0042417 | A1 | 3/2006 | Gash et al. | |
| 2007/0142643 | A1 | 6/2007 | Huynh et al. | |
| 2009/0011319 | A1 * | 1/2009 | Joboji | H01M 4/8605 429/430 |
| 2010/0190639 | A1 | 7/2010 | Worsley et al. | |
| 2011/0117338 | A1 * | 5/2011 | Poquette | C23C 18/1644 428/213 |
| 2012/0235073 | A1 | 9/2012 | Seo et al. | |
| 2013/0021718 | A1 | 1/2013 | Yager et al. | |

* cited by examiner

COATING FOR METAL CELLULAR STRUCTURE AND METHOD THEREFOR

CROSS-REFERENCE TO RELATED APPLICATION

This application claims priority to U.S. Provisional Application No. 61/894,650, filed Oct. 23, 2013.

BACKGROUND

This disclosure relates to coating porous metal foams. Porous metal foams, for example nanoporous foams or aerogels, are known and used in filters, electrodes, catalysts, refractory articles and other applications. The porous metal foams can be fabricated using processes such as combustion synthesis or metal de-alloying.

SUMMARY

A method of fabricating a metal cellular structure with a coating according to an example of the present disclosure includes providing a sol-gel that is a colloid dispersed in a solvent. The colloid includes metal-containing regions bound together by polymeric ligands. The solvent is then removed from the gel using supercritical drying to produce a dry gel of the metal-containing regions bound together by the polymeric ligands. The dry gel is then thermally converted to a cellular structure with a coating in at least one step using phase separation of at least two insoluble elements.

In a further embodiment of any of the foregoing embodiments, the metal-containing regions are metal oxide, and the converting of the metal-containing regions includes reducing the metal oxide to metal.

In a further embodiment of any of the foregoing embodiments, the metal of the metal-containing regions is selected from the group consisting of copper, chromium, molybdenum, yittrium, zirconium, hafnium, ruthenium, cobalt, manganese, iron, nickel and combinations thereof.

In a further embodiment of any of the foregoing embodiments, the providing of the sol includes mixing together a polymer precursor and a metal salt in the solvent.

In a further embodiment of any of the foregoing embodiments, the polymer precursor includes propylene oxide.

In a further embodiment of any of the foregoing embodiments, the supercritical drying includes using supercritical carbon dioxide.

In a further embodiment of any of the foregoing embodiments, the thermal decomposing of the polymer ligands is conducted at a first treatment temperature of less than 400° C. in an oxygen environment.

In a further embodiment of any of the foregoing embodiments, at least one stage of the thermal converting of the metal-containing regions is at a second treatment temperature of about 400° C. or greater in a controlled-gas environment that is substantially free of oxygen.

In a further embodiment of any of the foregoing embodiments, the interconnected metal ligaments have a nanosize width dimension.

In a further embodiment of any of the foregoing embodiments, the decomposing of the polymer ligands produces gaseous byproducts and residual solid carbon, and further comprising forming a carbon-containing coating around the interconnected metal ligaments using the residual solid carbon.

A method of fabricating a metal cellular structure according to an example of the present disclosure includes providing a dry gel of metal-containing regions bound together by polymeric ligands, thermally decomposing the polymer ligands into gaseous byproducts and residual solid carbon, thermally converting the metal-containing regions to interconnected metal ligaments having a cellular structure, and forming a carbon-containing coating around the metal ligaments using the residual solid carbon.

In a further embodiment of any of the foregoing embodiments, the thermal decomposing of the polymer ligands is conducted at a first treatment temperature of less than 400° C. in an oxygen environment.

In a further embodiment of any of the foregoing embodiments, at least one stage of the thermal converting of the metal-containing regions is at a second treatment temperature of about 400° C. or greater in a controlled-gas environment that is substantially free of oxygen.

In a further embodiment of any of the foregoing embodiments, the carbon-containing coating includes graphene.

In a further embodiment of any of the foregoing embodiments, the carbon-containing coating includes amorphous carbon.

In a further embodiment of any of the foregoing embodiments, the carbon-containing coating includes at least one layer of amorphous carbon and at least one layer of graphene.

A metal nanocellular structure according to an example of the present disclosure includes interconnected metal ligaments having a cellular structure, and a carbon-containing coating around the metal ligaments.

In a further embodiment of any of the foregoing embodiments, the carbon-containing coating includes graphene.

In a further embodiment of any of the foregoing embodiments, the carbon-containing coating includes amorphous carbon.

In a further embodiment of any of the foregoing embodiments, the carbon-containing coating includes at least one layer of amorphous carbon and at least one layer of graphene.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
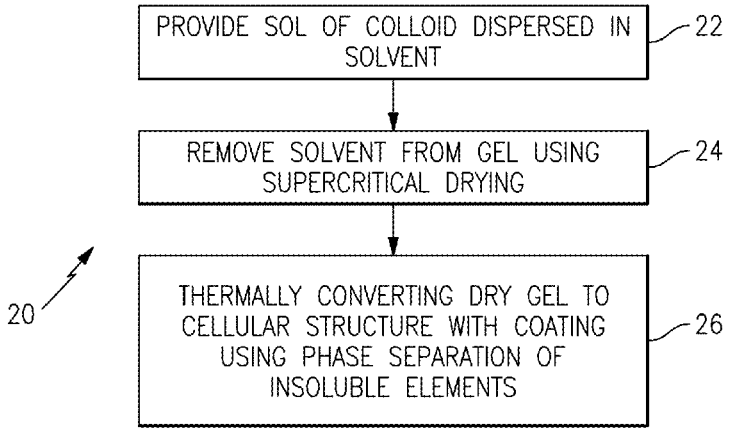
FIG. 1 illustrates an example method of fabricating a metal cellular structure with a coating.

Metal cellular structures can be fabricated using solution chemistry, combustion synthesis, electroplating or metal de-alloying, for example. Metal cellular structures have open void areas that extend between interconnected metal ligaments. In a nanofoam, the metal ligaments have a nanosize width dimension that is less than one micrometer and can be less than 500 nanometers or less than 100 nanometers. A cellular structure having a coating on the ligaments could be useful in applications such as additives in composites, gas turbine engines components and chemical sensors. In this disclosure, the method for coating a metal cellular structure by phase separation is presented. FIG. 1 illustrates an example method 20 of fabricating a metal cellular structure with a coating.

Carbon based coatings on metals can be achieved using a variety of techniques including chemical vapor deposition and post treatment with organic materials. These methods become impractical as pore size decreases, which limits diffusion of coating precursor or material into the cellular material. As will be described in further detail below, the disclosure provides a technique for producing a carbon coating for metal cellular structures and nanofoams from a colloid. The colloid can be composed of nanoparticles, nanowires or nanoplatelets.

The method 20 is a sol-gel technique and will be described with respect to steps 22, 24 and 26, although it is to be understood that the steps 22, 24 and 26 can be used in combination with other processing steps. The starting material for step 22 is a sol. The sol is a mixture of precursor materials in a solvent. In one example, the sol contains dispersed metal-containing compounds, a monomer and a solvent that is a non-aqueous and polar. Selection of monomer and metal-containing compound are important considerations, which impact the structure and coating of the nanocellular material.

Figure 2:
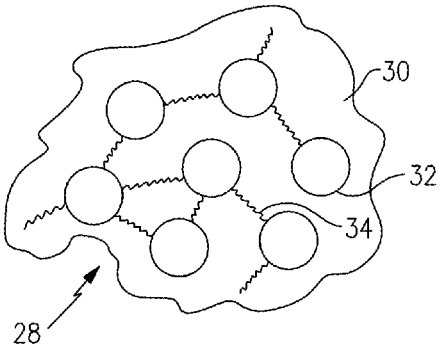
FIG. 2 illustrates a representative portion of an example sol-gel used in the method of FIG. 1.

In FIG. 1, step 22, the sol is converted to a gel. This occurs when the precursor materials react. In the present example, the metal-containing compounds react with the monomer to form metal containing regions bound by polymer ligands. FIG. 2 shows a representative portion of an example gel 28 used in the method 20. The sol 28 includes a solvent 30 and metal-containing regions 32 bound together by polymeric ligands 34. For example, the gel 28 is a mixture of the solvent 30 with a metal salt and an epoxide polymer precursor. The metal from the salt initiates a reaction to polymerize the polymer precursor and agglomerate metal-intermediates into metal-containing regions 32 bound together by the polymeric ligands 34.

The metal from the salt will later form the metal ligaments of the final metal cellular structure. Thus, the metal of the metal salt is selected in accordance with the desired metal in the final cellular structure. For example, the metal can include copper, chromium, molybdenum, yittrium, zirconium, hafnium, ruthenium, cobalt, manganese, iron, nickel and combinations thereof. Example metal salts can include metal chlorides and metal nitrides, but are not limited to these. The metal salt during the reaction converts to metal/metal oxide particles. In the present example, the round particle size in one example is approximately 5 nm. However, nanowires, nanoplatlets or other nanosized particles with at least one dimension being in the nanometer range can also be used. The metal-containing regions 32 thus include the metal from the salt.

The polymeric precursor is reactive in the solvent with the metal salt. The metal salt catalyzes a polymerization reaction wherein the polymeric precursor polymerizes to form the polymeric ligands. One example polymer precursor that is reactive with the above-described metals is propylene oxide ($CH_3CHCH_2O$). The propylene oxide reacts to form epoxide polymeric ligands 34 and metal intermediates, such as oxides of the metal, which agglomerate as metal-containing regions 32.

Step 24 is a drying step to convert the gel into a dry gel. In step 24, the solvent is removed from the gel using supercritical drying to produce a dry gel of the metal-containing regions bound together by the polymeric ligands. The word "dry" thus refers to the lack of solvent in the gel, regardless of the type of solvent used. The dry gel thus has less solvent than the sol, although some residual solvent may remain after drying. In some examples, the dry gel can be substantially free of solvent.

In one example, the solvent is removed using supercritical carbon dioxide. Supercritical carbon dioxide is a fluid state of carbon dioxide in which the carbon dioxide is at or above its critical temperature and critical pressure. Carbon dioxide has a critical temperature of approximately 304 Kelvin and a critical pressure of 72.9 atm (7.39 MPa).

The removal step 24 can be conducted in an environment- and temperature-controlled chamber. The temperature and environment pressure in the chamber can be adjusted to provide carbon dioxide in a supercritical state to infiltrate the sol. The pressure can then be reduced, while maintaining temperature, to convert the supercritical carbon dioxide to gas below the supercritical point. The gas gently removes the solvent from the sol, and thus reduces or avoids collapse of the drying gel.

Step 26 of method 20 is a heat treatment step to convert the dry gel to a metal cellular structure. For example, the heat treatment can include one or more heat treatment stages defined by heating/cooling rates, gas environments, hold times and hold temperatures. Each stage can serve to carry out one or more functions with respect to converting the dry gel to a metal with a carbon coating. The formation of a coating occurs when at least two insoluble elements that were initially in a mixture phase separate. The phase separation occurs depending on the solubility of the two or more elements. In the present case metals and carbon are insoluble over a wide range of temperatures. The heat treatment process controls the cellular structure as well as the coating dimensions.

The dry gel from the drying step 24 includes the metal-containing regions 32 and polymeric ligands 34. At least one stage of the heat treatment serves to decompose and/or remove (i.e., "burnout") the polymeric ligands 34. For example, at least one stage of the heat treatment thermally cracks the polymeric ligands 34 into smaller molecules as a gaseous byproduct. A residual amount of carbon from the polymeric ligands 34 can remain in the metal-containing regions 32.

The metal-containing regions 32 can include oxides or other non-metallic forms of the metal. At least one stage of the heat treatment serves to convert the oxides or other non-metallic forms to metal. For example, at least one stage of the heat treatment chemically reduces the metal oxides to metal.

At least one stage of the heat treatment also consolidates or sinters the metal nanoparticles, nanowires or nano-platelets to form metal ligaments in a metal cellular structure. The stage or stages of the heat treatment that decompose and remove the polymeric ligands 34 and convert the oxides or other non-metallic forms to metal can be conducted at a lower temperature than the temperature used for the stage or stages that consolidate the metal. Additionally, one or more stages of the heat treatment can be conducted in an oxygen-containing environment, such as air, a substantially oxygen-free environment, or a combination thereof through different stages. The heat treatment ramp impacts the final geometry and subsequent coating of the cellular material.

One or more stages of the heat treatment can include annealing for a defined hold time at an annealing temperature to consolidate the metal after the thermal decomposing of the polymer ligands 34, conversion of the oxides or other non-metallic forms to metal and formation of the carbon coating. In one example, the annealing is conducted at a temperature of 275° C.-1000° C., and preferably at an annealing temperature of 500° C. or greater, in a controlled-gas environment that is substantially free of oxygen with a hold time of 0.1 to 32 hours. One example environment that is substantially free of oxygen is an environment of predominantly argon and hydrogen. The argon is inert, and the hydrogen serves to reduce oxides that may occur from any small amounts of oxygen that are present in the process environment. The resulting heat treatment produces cellular foams with a carbon coating.

The heat treatment, or stages thereof, can be controlled with respect to heating rate, temperature, hold time(s) and gas environment to effectively serve the above functions. In one example, the thermal decomposing of the polymer ligands 34 and conversion of the oxides or other non-metallic forms to metal is conducted at a first treatment temperature or temperature range in an oxygen-containing environment. Air is one example oxygen environment, although other oxygen-containing environments could also be used. The oxygen serves to chemically crack the polymer ligands 34. Temperatures of approximately 275° C.-1000° C., or even higher, can be used to decompose the polymeric ligands, convert oxides or other non-metallic forms to metal and control the carbon content.

Figure 4:
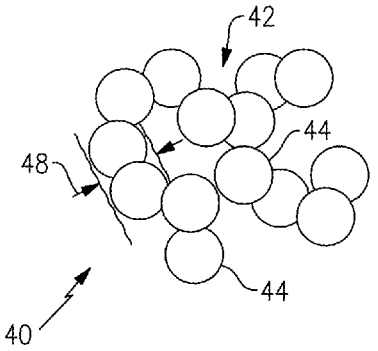
FIG. 4 schematically illustrates a representative portion of the metal cellular structure of FIG. 3.
Figure 3:
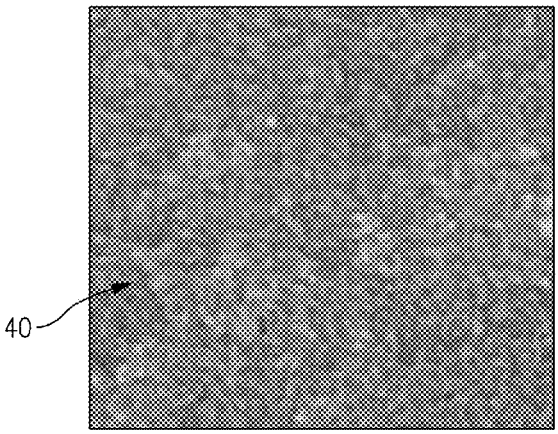
FIG. 3 is a micrograph of a metal cellular structure fabricated according to the method of FIG. 1.

FIG. 3 shows a micrograph of a metal cellular structure 40 fabricated according to the method 20, and FIG. 4 schematically shows a representative portion of the metal cellular structure 40. The structure 40 includes interconnected metal ligaments 42 formed by metal grains 44. The metal grains 44 are vestiges of the metal-containing regions 32 from the sol and dry gel of the method 20. The interconnected metal ligaments 42 have an average width dimension 48. In one example, the average width dimension 48 is less than 1 micrometer, less than 500 nanometers, or less than 100 nanometers (i.e., nanosized).

Figure 5:
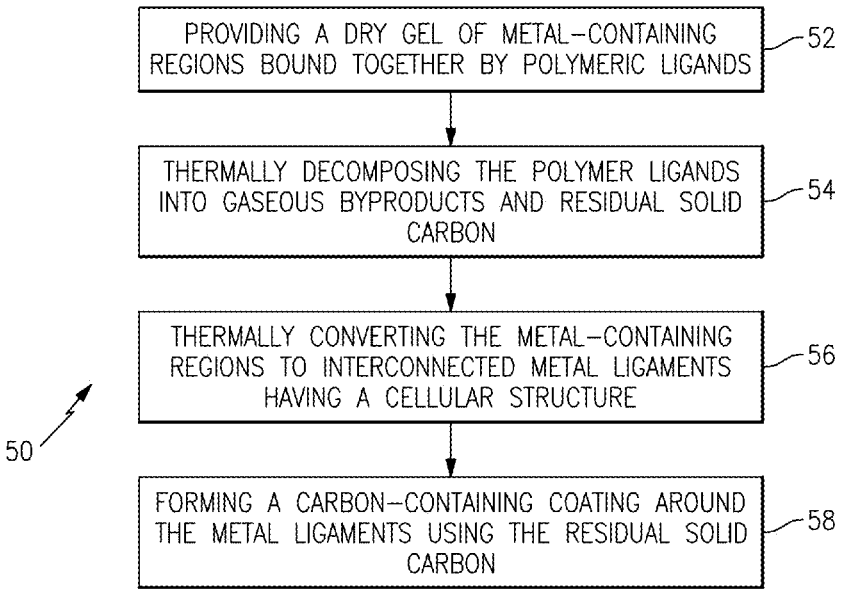
FIG. 5 illustrates another aspect of a method of fabricating a metal cellular structure.

FIG. 5 illustrates the aspect of a technique according to this disclosure. A method 50 of fabricating a metal cellular structure includes steps 52, 54, 56 and 58, although it is to be understood that the steps can be used in combination with other processing steps. In this example, step 52 includes providing a dry gel of metal-containing regions bound together by polymeric ligands. The dry gel can be pre-prepared, prior to the method 50, and then provided as a starting material at step 52. Alternatively, step 52 can include preparation of the dry gel, as described with reference to steps 22 and 24.

Step 54 of method 50 is a heat treatment step to thermally decompose the polymer ligands into gaseous byproducts and residual solid carbon, and step 56 is a heat treatment step to thermally convert the metal-containing regions to interconnected metal ligaments having a cellular structure. Steps 54 and 56 can, collectively, be similar to the heat treatment of step 26 of method 20, but further include positively controlling the thermal decomposition of the polymer ligands to intentionally provide residual solid carbon. The normal objective in a "burnout" would be to completely remove the material being burned out. However, contrary to normal burnout objectives, at least one stage of the heat treatment can be controlled to intentionally provide residual solid carbon, with a view to later using the residual carbon to form a coating on the metal ligaments of the cellular structure.

For example, as described above, the thermal decomposing of the polymer ligands can be conducted at a treatment temperature or temperature range in an oxygen environment. However, the amount of oxygen, temperature and/or hold time can be adjusted such that a target amount of residual carbon remains. Relatively higher amounts of oxygen would generally reduce the amount of residual carbon, and vice versa.

In some examples, the residual carbon in the carbon-containing coating, along with any residual carbon trapped in the metal ligaments can provide the metal cellular structure with good electrical conductivity for use in electrical applications. The carbon-containing coating can also serve to provide functional bonding or attachment sites of the metal cellular structure to other, chemically dissimilar materials, such as polymers.

The carbon of the carbon-based coating can be amorphous carbon, crystalline carbon, or combinations thereof. In one example, the carbon is graphene. Graphene has a hexagonal atomic arrangement of carbon atoms in a layer that is one atom thick. In another example, the carbon forms a multi-layer coating around the individual interconnected metal ligaments. The multi-layer coating can include one or more amorphous carbon layers, one or more crystalline carbon layers, or combinations thereof.

Figure 6A:
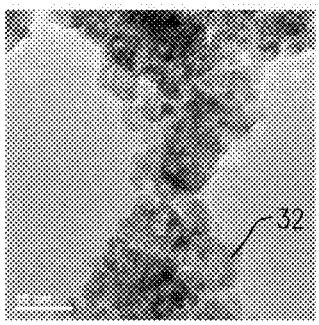
FIGS. 6A, 6B and 6C are, respectively, micrographs of a structure at various stages of the method of FIG. 5.
Figure 6B:
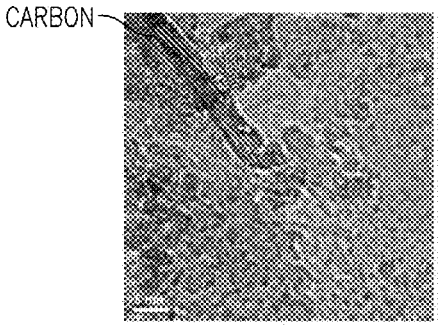
Figure 6D:
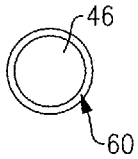
FIG. 6D is illustrates a schematic cross-sectional view of the coated metal cellular structure of FIG. 6C.
Figure 6C:
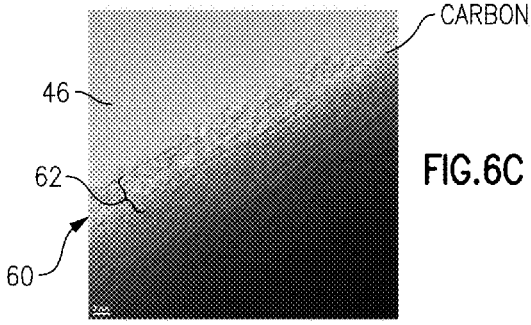

FIGS. 6A, 6B and 6C show respective micrographs of a sample at various stages through the method 50. FIG. 6A depicts a representative portion of a dry gel at step 52 (and producible by steps 22 and 24 of method 20). In this example, the metal-containing regions 32 are nickel oxide (NiO). FIG. 6B depicts a representative portion of a cellular structure during heat treatment at step 54. The darker regions or bands are residual carbon that is trapped in metal or metal-containing regions. FIG. 6C shows a representative portion of a final coated metal cellular structure having a metal ligament 46 and carbon-containing coating 60. The metal ligament 46 and carbon-containing coating 60 are also shown a schematic cross-sectional view in FIG. 6D. In this example, the structure was anneal heat treated at 500° C. for eight hours to migrate the carbon to the surface of the metal ligament 46 to form the carbon-containing coating 60. The carbon-containing coating includes a plurality of layers 62 (FIG. 6C). The layers closest to the outer surface of the metal ligament 46 are amorphous, and the layers farthest from the surface are crystalline (graphene).

The phase separation of metal and carbon is a representative example, and any two or more insoluble elements can be used to prepare a similar metal with coating based on appropriate selection of the precursor materials. The process and steps outlined above would be yield a similar result. The initial development of a gel would consist of the colloid in a solvent. The metal containing region of the colloid bound by a suitable polymer ligand can contain the insoluble element precursor material. The insoluble element can be a nanosized particle or incorporated into one of the starting materials.

At an initial stage of heat treatment, the insoluble element may be present primarily on the surfaces of the metal-containing regions. However, at one or more stages of the heat treatment of step 56 to thermally convert the metal-containing regions to interconnected metal ligaments, the converted metal traps at least a portion of the insoluble elements. Some of the insoluble elements may be lost to volatilization during the heat treatment of step 56. However, upon annealing the metal cellular structure at step 58, the trapped insoluble element phase separates from the metal and migrates to the surfaces of the interconnected metal ligaments. The surface-migrated residual insoluble elements form a coating around the individual interconnected metal ligaments.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of fabricating a metal cellular structure with a coating, the method comprising:

providing a sol-gel that is a colloid dispersed in a solvent, the colloid including metal-containing regions bound together by polymeric ligands;

removing the solvent from the gel using supercritical drying to produce a dry gel of the metal-containing regions bound together by the polymeric ligands; and thermally converting the dry gel to a cellular structure with a coating in at least one step using phase separation of at least two insoluble elements.

2. The method as recited in claim 1, wherein the metal-containing regions are metal oxide, and at least one stage of the thermal converting includes reducing the metal oxide to metal.

3. The method as recited in claim 1, wherein the metal of the metal-containing regions is selected from the group consisting of copper, chromium, molybdenum, yittrium, zirconium, hafnium, ruthenium, cobalt, manganese, iron, nickel and combinations thereof.

4. The method as recited in claim 1, wherein the providing of the sol includes mixing together a polymer precursor and a metal salt in the solvent.

5. The method as recited in claim 4, wherein the polymer precursor includes propylene oxide.

6. The method as recited in claim 1, wherein the supercritical drying includes using supercritical carbon dioxide.

7. The method as recited in claim 1, wherein at least one stage of the thermal converting includes thermally decomposing the polymer ligands at a first treatment temperature of less than 400° C. in an oxygen environment.

8. The method as recited in claim 7, wherein at least one stage of the thermal converting includes thermally converting the metal-containing regions to interconnected metal ligaments at a second treatment temperature of about 400° C. or greater in a controlled-gas environment that is substantially free of oxygen.

9. The method as recited in claim 8, wherein the interconnected metal ligaments have a nanosize width dimension.

10. The method as recited in claim 8, wherein the decomposing of the polymer ligands produces gaseous byproducts and residual solid carbon, and further comprising forming a carbon-containing coating around the interconnected metal ligaments using the residual solid carbon.

11. A method of fabricating a metal cellular structure, the method comprising:

providing a dry gel of metal-containing regions bound together by polymeric ligands;

thermally decomposing the polymer ligands into gaseous byproducts and residual solid carbon;

thermally converting the metal-containing regions to interconnected metal ligaments having a cellular structure; and forming a carbon-containing coating around the metal ligaments using the residual solid carbon.

12. The method as recited in claim 11, wherein the thermal decomposing of the polymer ligands is conducted at a first treatment temperature of less than 400° C. in an oxygen environment.

13. The method as recited in claim 12, wherein at least one stage of the thermal converting of the metal-containing regions is at a second treatment temperature of about 400° C. or greater in a controlled-gas environment that is substantially free of oxygen.

14. The method as recited in claim 11, wherein the carbon-containing coating includes graphene.

15. The method as recited in claim 11, wherein the carbon-containing coating includes amorphous carbon.

16. The method as recited in claim 11, wherein the carbon-containing coating includes at least one layer of amorphous carbon and at least one layer of graphene.

* * * * *